US006050207A

United States Patent [19]

Mays

[11] Patent Number: 6,050,207

[45] Date of Patent: Apr. 18, 2000

[54] DESCRIPTION AND OPERATION OF A FLOOD CONTROL DEVICE FOR MOST ANY OBJECT

[76] Inventor: Vance H. Mays, P.O. Box 214, Franklin, Pa. 16323

[21] Appl. No.: 09/245,690

[22] Filed: Feb. 5, 1999

Related U.S. Application Data

[60] Provisional application No. 06/074,056, Feb. 9, 1998.

[51] Int. Cl.[7] ..... B63C 1/02

[52] U.S. Cl. ..... 114/45; 52/169.9

[58] Field of Search ..... 52/169.2, 169.9; 114/45, 261, 264, 61, 123

[56] References Cited

U.S. PATENT DOCUMENTS

| | | | |
|---|---|---|---|
| 3,166,037 | 1/1965 | Otis | 114/5 |
| 4,381,723 | 5/1983 | Furst | 114/45 |
| 5,131,109 | 7/1992 | Grip et al. | 14/28 |
| 5,347,949 | 9/1994 | Winston | 114/264 |
| 5,398,635 | 3/1995 | Tellington | 114/261 |
| 5,588,387 | 12/1996 | Tellington | 114/261 |
| 5,647,693 | 7/1997 | Carlinsky et al. | 52/169.9 |
| 5,799,603 | 9/1998 | Tellington | 114/261 |
| 5,904,446 | 5/1999 | Carlinsky et al. | 52/169.9 |

*Primary Examiner*—Stephen Avila
*Attorney, Agent, or Firm*—Bruce P. Bardes

[57] ABSTRACT

A device for protecting objects such as houses, industrial and commercial buildings, storage vessels, boat moorings, and the like from rising water, as in floods, is described. The device comprises a lifting component, termed a liquilift, which act to raise the objects being protected above the rising water. Two types of liquilifts, sealed and nonsealed, are described. Although a single liquilift may be used effectively to protect objects from rising water, preferred embodiments of the invention employ several liquilifts. For example, one form of the invention provides for a generally rectangular support frame, to which the object being protected is attached, to be supported by four liquilifts, disposed near the corners of the support frame. Controls to sense the level of rising water, and to maintain the support frame in a horizontal position, are described. The device also includes a power supply to activate the components thereof.

14 Claims, 6 Drawing Sheets

DESCRIPTION AND OPERATION OF A FLOOD CONTROL DEVICE FOR MOST ANY OBJECT

RELATED APPLICATION

Priority is claimed for this application under the provisions 35 U.S.C. §119 (e), based on Provisional Application No. 60/074,056, filed by Vance H. Mays on Feb. 9, 1998.

BACKGROUND OF THE INVENTION

1. Field of the Invention

The invention relates to a device for protecting objects such as buildings, storage tanks, mooring docks and the like from damage that may occur from rising water, as in floods. The invention also includes key components of said device that act to protect said objects from flood damage by raising those objects above the level of the water.

2. Background Art

Every year, damage caused by flooding amounts to billions of dollars. Mankind has attempted to control floodwaters through such means as dams, levees, floodwalls, impoundment reservoirs, and the like. The cost of such means generally limits the application thereof to densely populated regions, where many people can benefit therefrom. However, when floodwaters rise beyond the capabilities of such means, or when floodwaters rise in areas not protected by such means, it is usually necessary to resort to temporary levees constructed by sandbagging, or else to admit defeat and allow the floodwaters to rise. As the floodwaters rise, objects such as buildings, storage tanks, mooring docks, and the like, in the path of the rising water may be damaged thereby, similarly, anything inside such buildings may also be damaged by the floodwaters.

It is easy to suggest that flood damage could be prevented by not constructing any object that may be damaged by floodwaters on land that is subject to flooding. However, there are two reasons why this approach is generally impractical. First, it is difficult to define which areas near a waterway are subject to flooding. Suppose one has access to historical records; one could define a flood plain as the land that was covered by the highest flood ever recorded, or as the highest flood recorded in the last 100 years, or by some other criterion. Just as surely as historical records are used to define a flood plain, some subsequent flood may exceed the historical standard. Second, land within the flood plain frequently has very high value, for several reasons. As rivers, estuaries and the like are frequently utilized for transportation by boat, the term being used herein to include ships and barges, it is necessary to construct facilities for loading and unloading cargo from such boats. Such facilities are necessarily situated adjacent to waters that are navigable in normal conditions, i.e., other than flood conditions. Flood plains also provide convenient locations for other means of transportation, notably railroads and highways. It is generally less expensive to build and operate such means of transportation along a river than overland. Many industrial processes require large quantities of water, and industries utilizing these processes must be located near an appropriate source of water. In electric power generation, for example, efficiency is enhanced by the use of cooling water. Paper is made by suspending cellulose fibers in water, and then pouring the suspension through a screen to create a felt-like substance, and squeezing the water out of that felt-like substance to create a sheet of paper. In addition, it is desirable to build residential and commercial buildings in locations near transportation facilities and manufacturing plants, so that flood plains become attractive locations therefor. It is also easier and less expensive to construct such buildings of flat terrain, such as a flood plain, than on adjacent sloping terrain. On a global scale, the amount of land deemed commercially useful is small enough that excluding flood plains therefrom would be unacceptable. In some regions, such as parts of China, land is so scarce that people build houses on wood pilings driven into the bottoms of waterways, or they live on boats. With the increasing population of the world, it is likely that mankind will continue to build on flood plains.

A logical extension beyond building a structure on a boat is constructing a floating structure that is constrained to a particular location. Such a structure typically remains at the same level relative to the surface of the water, even though the water may rise far above its normal level. Access to dry land is achieved through a rolling or swinging gangplank. Otis (U.S. Pat. No. 3,166,037) has described one such structure, though the objects of his invention relate primarily to the design and methods of construction thereof. Such structures are commonly constrained to a particular location by cables attached at one end to the floating structure and at the other end to anchoring devices built into the banks of the waterway. Alternatively, vertical posts driven into the bottom of the waterway may be used to constrain movement of the floating structure. As structures of this type float on the water at all times, they arc sensitive to waves and other local perturbations in the surface of the water. As a result, the structure may rock to and fro, and its structural members may also be subjected to considerable stress as one portion thereof may be raised more than other portions.

Floating structures for purposes other than residential and commercial buildings, and boat moorings, have been described. As an extreme example, Tellington (U.S. Pat. Nos. 5,398,635, 5,588,387 and 5,799,603) has described a floating airport. He has described means for maintaining the floating airport in its intended location by continually maneuvering it to head into the wind at the intended location. He has also described means for absorbing much of the motion of the waves, so that the floating airport can be kept flat and level, in spite of the waves. Grip et al (U.S. Pat. No. 5,131,109) have described a pontoon bridge that is tethered to the bottom of the waterway, with sufficient downward force applied through the tethers to keep the pontoons more nearly submerged that the normal buoyancy thereof would dictate. This approach reduces the likelihood that their bridge would rock to and fro as a result of waves on the surface of the water, and it also minimizes rocking of the bridge due to movement of vehicles on the bridge. Each of the structures described in the patents cited above floats all the time, supported by the water. As a result, there must always be some provision for connecting the floating structure to dry land, such as a gangplank or a service boat, and some provision for connecting the floating structure to land-based utilities, such as electricity, drinking water, fuel for heating, and the like.

A structure built on stilts, such as that described above, creates access problems for the user thereof. If such a structure is attached to pilings embedded in the bottom of the waterway, access is gained through boats or bridges. Such a structure offers no protection against rising and falling of the water level. In some parts of the United States, notably on the Outer Banks of North Carolina, houses are built on pilings embedded in the sand near the waterfront. The objective of such construction is to allow the high waves associated with stormy weather to sweep over the beach, but beneath the living area of the house. As the waves cannot smash into the living area of the house, damage thereto is avoided. The same construction has been applied to construction on the flood plain adjacent to a river, for the same reason. However, in either case, access to the living area can be gained only by means such as stairs, ramps, elevators and the like. With respect to structures built on stilts, several issues must be addressed. If the structure is to be built on pilings in the bottom of the waterway, is the utilization of the airspace over the surface of the water for structures economically feasible, given the higher cost of construction and access problems associated therewith? Is the protection against variations in water level sufficient? If the structure is to be built on pilings embedded in the earth near a waterway, does the reduced risk of damage from floodwater justify the increased construction cost and inconvenience of access?

In U.S. Pat. No. 5,347,949, Winston has described what he calls a floating, or floatable, house. The latter term is more descriptive, because the house rests on a land-based foundation, except during times of high water. Then it floats on pontoons made of foam polymeric material, and on air bladders adjacent thereto. Telescoping piers serve to constrain the floating house to a specified location. Winston's stricture becomes a floating structure, subject to the limitations and inconveniences discussed above, when the water level rises sufficiently.

There is another class of devices, floating dry docks, that is only remotely germane to the present field of art. These are devices that can be at least partially submerged to place a boat therein, and then floated to raise a boat out of the water for maintenance. Furst (U.S. Pat. No. 4,381,723) describes one such device that is tethered to the bottom of a waterway by a parallelogram linkage. It may be construed as analogous to Winston's house, to the extent that expelling water from buoyancy chambers therein provides means for keeping the upper surface of the drydock above a varying water level. However, the concept of partially submerging a drydock to place a boat therein is not related to the problem addressed by the present invention, namely, to keep an object above the water in spite of rising water level.

It is believed that the flood protection device, as set forth herein, is neither taught nor rendered obvious by the prior art cited above.

SUMMARY OF THE INVENTION

It is an object of the present invention to provide a device for protecting an object, such as a building, a storage tank, a mooring dock, or the like, from damage that may be caused by rising water around that object, as in floods.

It is an object of the present invention to provide a device than permits such an object to rest on its earthbound foundation, except during times of high water.

It is an object of the present invention to provide a device that maintains such an object in a level position and at a specified level, relative to mean water level, in spite of variations in distribution of weight therein, and in spite of loading thereof by wind or waves. In particular, it is an object of the present invention to provide an automated system for maintaining the level position and specified level without intervention by humans.

It is an object of the present invention to provide means for utilizing, for construction purpose, land which lies in the flood plain of a river, or in the tidal plain of the ocean, or an estuary thereof, or near such a tidal plain.

It is an object of the present invention to provide a lifting component therefor that generates sufficient lifting force to accomplish the foregoing objects.

The flood protection device of the present invention, as described herein, accomplishes these and other objectives through a novel combination of design concepts and embodiments thereof. Specifically, the device comprises lifting components and other structural and control elements to raise objects such as buildings, storage tanks, and the like, safely above rising floodwaters. The term "liquilift" is used herein to describe such a lifting component, comprising both sealed and nonsealed embodiments thereof.

One key element of the present invention is the liquilift. It is a self-contained unit that employs a pontoon sliding within an outside casing and floating on a controllable volume of operating liquid. The pontoon is sufficiently large that it is capable of supporting and lifting whatever object is being protected (or a proportional part of the weight of such an object, where multiple liquilifts are employed) from floodwaters, through the natural buoyancy of the pontoon. The lifting force is directed upward by a lift rod attached to the top of the pontoon. The assembly of the pontoon and the lift rod is maintained in a vertical orientation because the pontoon is shaped to slide within, and be constrained in its motion by, the interior of an outside casing and because bearing means, incorporated into a cover attached to a rim of the outside casing, constrain movement of the lift rod. The outside casing is embedded in the earth, except for a short distance below the rim of the outside casing. When an operating fluid is admitted to the outside casing, the hollow pontoon floats to a corresponding level, because of the natural buoyancy thereof The buoyancy of the pontoon, acting through the lift rod, raises whatever object is attached to the top of the lift rod. Control means, pumping means and power supply means are incorporated in the liquilift. Although useful service may be obtained from one or two liquilifts, preferred embodiments of the present invention incorporate three or more liquilifts.

In a sealed embodiment of the liquilift, a portion of the operating liquid is stored within the hollow pontoon, and then pumped out of the hollow pontoon and into the outside casing to raise the pontoon and lift rod assembly. To lower that assembly, the operating liquid is allowed to flow, or it is pumped, from the outside casing back into the pontoon. In this embodiment, seal means between the cover and lift rod excludes floodwater and dirt and debris carried therewith from the interior of the liquilift. In this embodiment, it is possible to employ an operating liquid that will not freeze if the liquilift is exposed to low ambient temperatures, and to incorporate corrosion inhibitors in the operating liquid.

In nonsealed embodiments of the liquilift, water from outside the liquilift is admitted to the outside casing thereof. Depending on the nature of the specific application, it may be appropriate for the water to flow free in and out of the liquilift under the force of gravity, or it may be necessary to pump the water in and out of the liquilift. These embodiments of the invention eliminate the need for a dedicated operating liquid. They also permit the outside casing to be drained of all liquid when it is not being used as a flood protection device. All liquilifts contemplated in the present invention, as described and claimed herein, are either sealed or nonsealed liquilifts.

Liquilifts may contain two or more lift rods, with appropriate modifications the cover to accommodate the additional lift rods.

The flood protection device of the present invention preferably includes three or more liquilifts, disposed in a noncollinear arrangement. The liquilifts are installed in the ground and adjusted such that the tops of the three lift rods are at substantially the same height when the lift rods of the liquilifts have been lowered to their lowest possible positions. A support frame rests on the tops of the lift rods, and provides support for whatever object is being protected. Sensors to indicate that the support frame is level and to detect the level of the rising floodwater, together with control means, are used to activate the control means of the individual liquilifts. A foundation is build directly upon the earth. It is designed such that the object being supported by the flood protection device will rest on the foundation at all times, except when there is a need for flood protection. The foundation may be designed to support the support frame, or it may be designed to support the object being protected. In another embodiment of the present invention, the foundation is omitted, and the object is supported by the liquilifts at all times.

Manual control means may also be incorporated in the flood protection device. The residents of a beachfront house equipped with the flood protection device of the present invention could thereby raise the house to its highest possible level in anticipation of high waves caused by stormy weather, or even a tsunami caused by an undersea earthquake.

Other objects and advantages of the present invention will be understood and appreciated by reference to the following detailed description of the invention, and the appended claims and drawings. It should be noted that like reference symbols in the drawings and related text indicate the same or similar components.

DETAILED DESCRIPTION OF THE INVENTION

Figure 1:
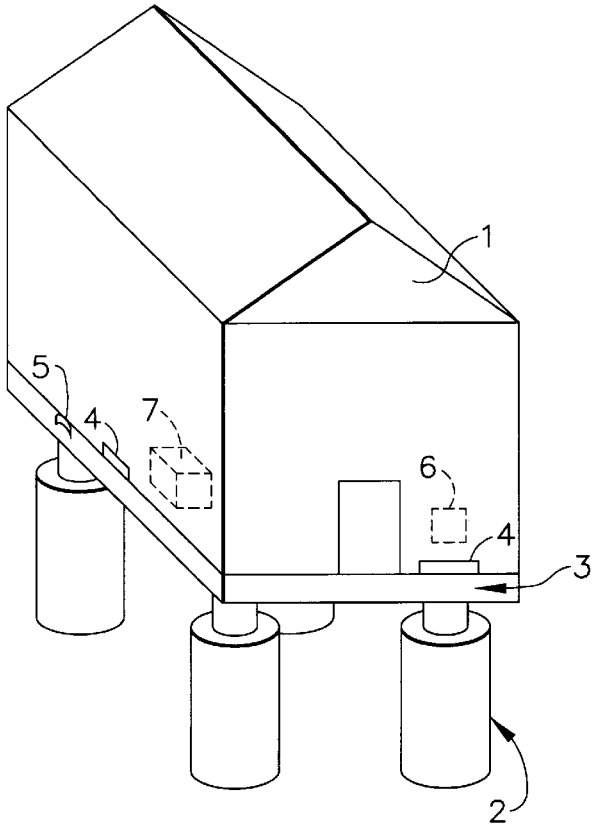
FIG. 1 illustrates, in schematic form, a building supported by a flood control device comprising four liquilifts.

The flood control device of the present invention is conveniently described through a general view thereof, followed by detailed descriptions of the key components thereof, and then descriptions of various embodiments thereof As indicated in the title of this invention, it is applicable to many types of structures, including, but not limited to, houses, industrial and commercial buildings, storage vessels and the like. It is illustrated herein, and in the drawings, as a house.

A general view of the flood control device of the present invention is presented in FIG. 1. The house to be protected 1 is supported by a support frame 3. The support frame 3 is supported in turn by four liquilifts, shown at 2. Leveling sensors 4 and flood level sensors 5 provide indications to a control means 6 of whether the floor is horizontal or not, and whether a flooding condition exists. At least two leveling sensors 4 would normally be attached to the floor of the structure, mounted perpendicularly to each other, to determine whether of not the floor is level in two perpendicular directions. At least one flood level sensor 5 is attached to the support frame, to indicate that floodwater has risen to the level of the support frame. The control means 6 acts in response to signals from sensors 4 and 5 to activate the liquilifts 2. Activation of the four liquilifts is done selectively, so that the floor remains level as the house is raised sufficiently to keep it above the floodwaters. Normally, the control means 6 operates automatically to keep the house safely above the floodwaters. However, the control means 6 optionally includes manual controls, so that an occupant can raise and lower the house at will. The control means 6 is preferably based on a computer, including appropriate input and output signal interface devices, to interface with sensors 4 and 5, and the liquilifts 2. It is believed that appropriate sensors and control means are commercially available, and thus, there is no need to describe these items in greater detail. Because in a flooding situation there is a very real possibility of a power outage, a backup power supply 7 is provided. Such a power supply, preferably located inside the house 1, will provide electric power for the control means, and also for any pumps and valves that may be incorporated in the liquilifts. The power supply will probably include a combination of rechargeable batteries and a gasoline-powered generator set. In a preferred embodiment of the invention, separate batteries are provided for the control means and all other electrical components in the flood control device, to preclude the possibility of electrical noise from motors, solenoids and the like interfering with a computer. If a suitable power supply is not commercially available, one could be readily assembled from commercially available components.

Figure 2:
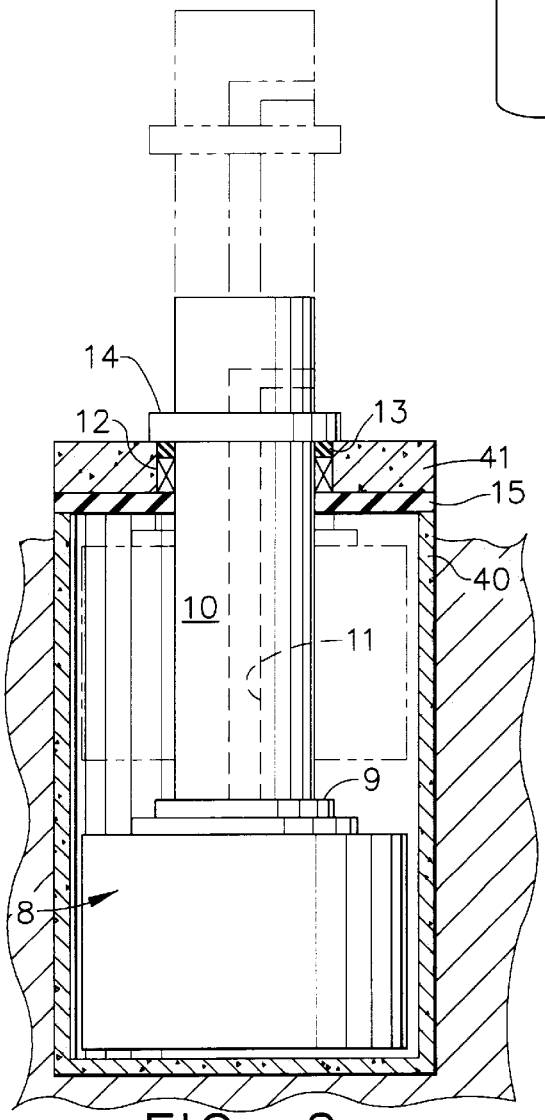
FIG. 2 illustrates, in schematic form, a liquilift. The internal construction of the liquilift is shown in a partial section therethrough. Dashed lines illustrate the extension of the liquilift to its fully raised position.
Figure 3:
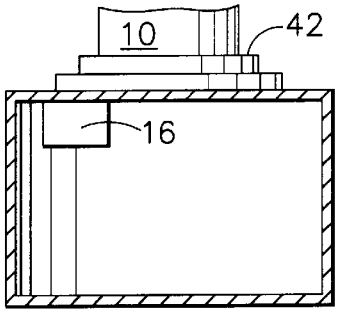
FIG. 3 illustrates, in schematic form, the internal construction of the pontoon of a liquilift.

The construction and operation of a liquilift is illustrated in FIGS. 2 and 3. A liquilift is constructed within an outside casing 40. The outside casing may be constructed on site, or it may be prefabricated in a factory. It is provided with a bottom and a sidewall, and a rim around the upper edge of the sidewall. The bottom and the sidewall are permanently joined together. Whatever material is selected for the outside casing must be sufficiently strong to accommodate the intended function of the liquilift, and it must resist degradation by contact with water, wet soil, and any operating liquid employed in the liquilift. Concrete is employed in a preferred embodiment of the present invention. A cover 41 is configured to mate with the rim of the outside casing 40. It is conveniently made of the same materials as the outside casing. The cover and outside casing are separably attached to each other, by means such as a series of bolts and nuts, which are not shown. Seal means therebetween, shown at 15, serve to exclude floodwaters from the interior of the liquilift. Vent means (not shown in the drawings) may be used to maintain air pressure at the top of outside case at ambient atmospheric pressure; such means cannot allow floodwaters to enter the liquilift.

The internal components of a liquilift comprise a pontoon 8 and a lift rod 10, which may be separably or permanently joined together, such as by bolting or welding. The pontoon 8 comprises a top, a bottom and a sidewall, sealed together to form a hollow vessel that can float on any liquid present inside the liquilift. The pontoon 8 may have any convenient cross sectional shape, but the interior of the outside casing 40 and the cover 41, must have a similar shape, such that vertical motion of the pontoon 8 is guided by the interior surface of the outside casing 40. Convenient and acceptable shapes for the pontoon 8 include spheres, cylinders and rectangular solids. If desired, other shapes can be employed. Note that if a spherical shape is selected for the pontoon 8, the distinction between the bottom, top and sidewall thereof is blurred, but this is inconsequential to the present invention. What is important in such a situation is that the interior of the outside casing be circular in cross sectional shape. Bearing means, not shown in the drawings, are preferably interposed between the interior of the outside casing and the pontoon, and attached to the latter, to provide improved support for the pontoon during operation of the liquilift. Such means may be pads of low friction polymeric material, such as high-density polyethylene. In order that the pontoon 8 can float on any liquid inside the outside casing 40, means must be provided for such liquid to flow around the pontoon. This may be accomplished by a gap between the pontoon and the outside casing, a groove in the interior wall of the outside casing, or a pipe through the pontoon that does not connect to the interior thereof.

The lift rod 10 transmits the buoyancy of the pontoon 8 to whatever object is being lifted thereby. Accordingly, the lift rod must be positioned over the center of the pontoon. Also, the pontoon must be sufficiently strong that it does not collapse from the load. In particular, the top and bottom of the pontoon cannot be allowed to collapse. Internal bracing inside the pontoon may be appropriate. The pontoon may be conveniently fabricated from steel, or, preferably, from a reinforced polymeric material. A flange 9 may be employed to distribute the load supported on the lift rod 10 over a larger portion of the top of the pontoon 8. A flange may also facilitate attachment of the lift rod to the pontoon. The lift rod 10 is preferably a tube of circular cross section. It must be of sufficient diameter and wall thickness as to support whatever load is applied to the top of the lift rod without buckling or collapsing. In one preferred embodiment of the present invention, a steel tube is employed. A tube constructed of a fiber-reinforced polymeric material is another preferred embodiment. If a solid lift rod is employed, a vent hole 11 is incorporated therein. The cover 41 is provided with means for the lift rod 10 to pass therethrough and be guided and sealed therewith. Specifically, bearing means 12 and seal means 13 are provided. The bearing means 12 may be a metallic, polymeric, or composite bushing, to guide the lift rod 10 therein. The seal means 13 serves to exclude floodwater, and silt and debris carried therewith, from the interior of the liquilift. An external stop ring 14 may be used to adjust the lowest possible position of the lift rod 10 and pontoon 8 within the liquilift. The stop ring also prevents point loading caused by resting the pontoon on the bottom of the liquilift, which could cause failure thereof. An adjustable internal stop ring 42 may be employed to limit the upward travel of the pontoon and lift rod assembly.

In one embodiment of the liquilift, an operating liquid is admitted to the interior of the liquilift, and the unit is sealed. Operation of the liquilift is achieved by transferring the operating liquid between the interior of the pontoon 8 to the space between the pontoon and the outside casing 40. Pumping the operating liquid into the pontoon decreases the buoyancy thereof and also lowers the level of the liquid within the outside casing. Thus, the pontoon and lift rod assembly is lowered into the outside casing. Pumping the operating liquid out of the pontoon has the opposite effect, namely, raising the pontoon and lift rod assembly. A pump 16 is used therefor. It may be a single reversible pump, or two separate pumps, operating in opposite directions. The pump 16 is conveniently situated inside the pontoon, as shown in FIG. 3. Pumping the operating liquid into the pontoon serves to reduce the amount of liquid that must be pumped, and also provides a convenient storage place for the operating liquid. The operating liquid may be any convenient substance, preferably having a specific gravity greater than about 0.5. Water may be used, but if so, it is preferably treated with corrosion inhibitors to reduce the extent of corrosive attack on metallic parts incorporated in the liquilift. Also, if the liquilift is to be installed in a cold climate, conduction of heat through a metallic lift rod may cause the operating liquid to freeze, even though the entire volume of operation might be below the local frost line. If so, an anti-freezing additive, such as ethylene glycol is advantageously incorporated into the operating liquid. Petroleum liquids could be employed, subject to appropriate attention to environmental concerns relative to leakage of the liquid into the surrounding earth.

The preferred amount of operating liquid used in a sealed liquilift may be computed as the volume of the outside casing 10, minus the volume of the exterior surfaces of the pontoon 8, lift rod 10, flange 9 and stop ring 42. The amount of operating liquid may be adjusted in accordance with the specific requirements of a particular application.

As each liquilift must support a significant weight, it is essential that a proper foundation be provided therefor. [Foundations are not shown in the drawings.] The only aspect of foundation design and construction requiring special consideration with respect the present invention is that the foundation must provide intimate contact and support to the entire bottom of the liquilift, lest the bottom of the liquilift fail from lack of support. Otherwise, design and construction of an appropriate foundation are well known in the art.

The size of a liquilift must be determined from the weight to be supported thereby. Increasing the cross sectional area of the pontoon 8 increases the load-carrying ability of the liquilift, but that also increases the cost of the liquilift and complicates construction thereof.

Those skilled in the art will recognize that a single liquilift, or a pair of liquilifts, may be employed to support an object and protect it from rising floodwaters. However, it will also be recognized that using one or two liquilifts subjects each liquilift to substantial load in a bending mode; this would increase the vulnerability of each lift rod 10 to collapse or buckling. Also, the use of a single liquilift eliminates the possibility of leveling any object supported thereby; such an object is necessarily rigidly affixed to the top of the lift rod, and remains at whatever slope is achieved thereby. From geometric considerations, it takes three liquilifts to support and level a structure supported thereby. Thus, the flood protection device of the present invention preferably includes at least three liquilifts. Because buildings and many other structures that may be protected by the present invention are generally rectangular in shape, the flood protection device of the present invention more preferably includes four liquilifts, as shown in FIGS. 1 and 4.

Figure 4:
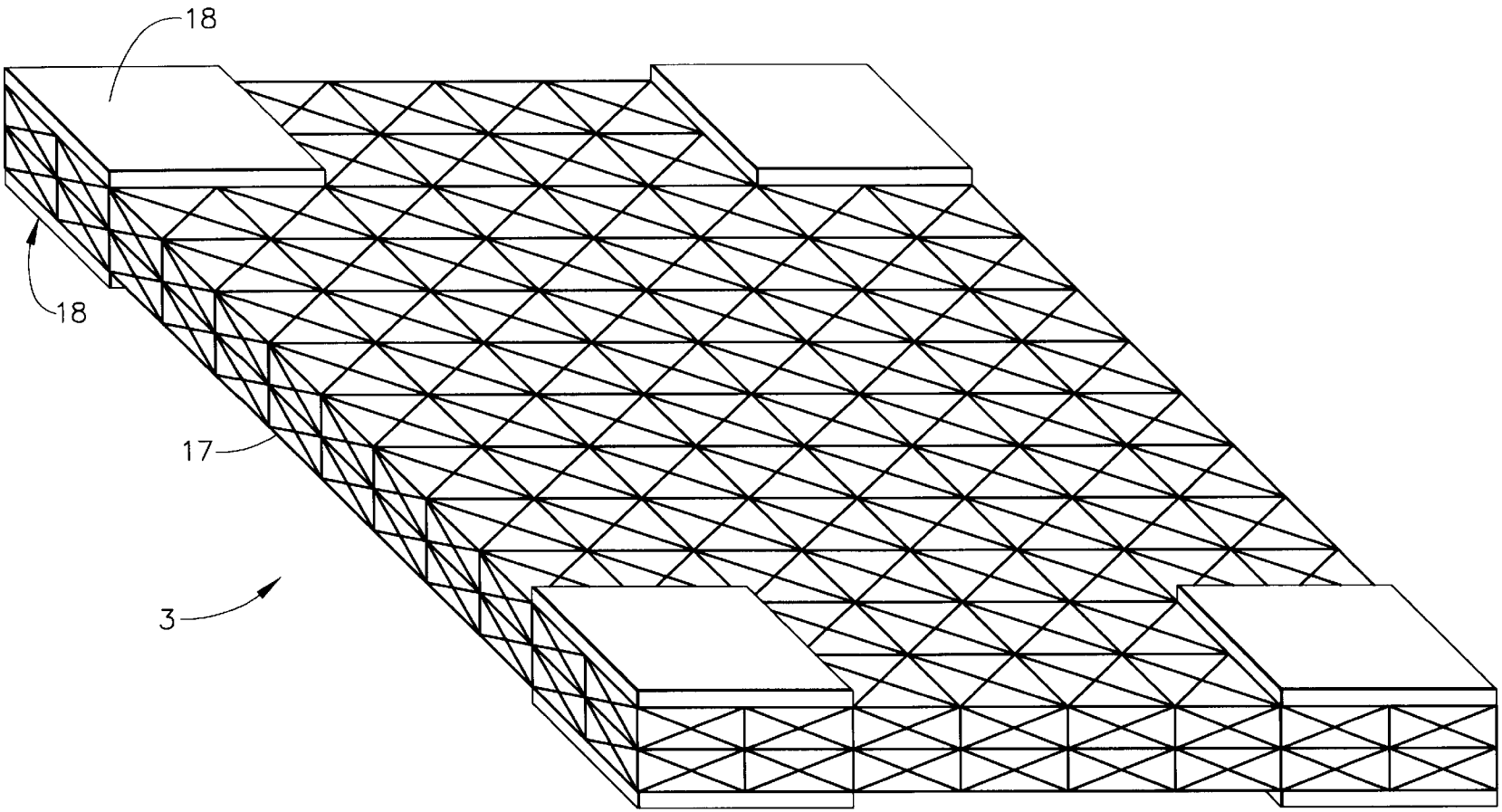
FIG. 4 illustrates, in schematic form, the support frame used in conjunction with four liquilifts to support a structure, as in FIG. 1.

The preferred construction of a support frame 3, configured for used with four liquilifts, is illustrated in FIG. 4. It includes eight mounting plates 18 and a main body 17 connecting the mounting plates. Four of the mounting plates are at the top of the support frame to facilitate attachment of the object to the support frame and four mounting plates are at the bottom of the support frame to facilitate attachment to the tops of the liquilifts. The main body is preferably designed as a three-dimensional truss, comprised of steel bars welded together. Its design and construction may be modified as desired, so long as it is sturdy enough and rigid enough to support the object being protected by the flood protection device of the present invention. As the water level sensor 5 is preferably attached to the support frame 3, at least the lower portion of the support frame must allow the flow of floodwater therethrough.

If the support frame 3 is constructed of a metallic material, it will expand in hot weather more than the earth below. Also, it is virtually impossible to align three or more liquilifts such that their axes of motion are exactly parallel. In either case, a significant amount of misalignment may occur. Thus, the support frame 3 preferably includes means to accommodate such misalignment. In one embodiment of the present invention, the top of the lift rod in a first of the four liquilifts 2 is provided with a pin joint connection to the corresponding mounting plate in the support frame 3. This joint permits rotation about a vertical axis of the support frame relative to the lift rod of the liquilift. The top of the lift rod in a second liquilift is provided with a sliding joint, configured to allow translational movement of the support frame relative to the lift rod only in the radial direction, relative to the first liquilift. The second liquilift is preferably diagonally opposite to the first. The tops of the lift rods in all other liquilifts are provided with sliding joints, to allow translational movement in any direction. Misalignment is thus accommodated, without sacrificing positive positioning of the object being protected, relative to the earth below.

Numerous variations in the design and construction of the flood protection device and the liquilifts incorporated therein. Some of these variations are illustrated and described herein, in FIGS. 5–8 and the accompanying text. Other variations, though not illustrated or described herein, are deemed to lie within the scope of the present invention, as claimed herein.

Figure 5:
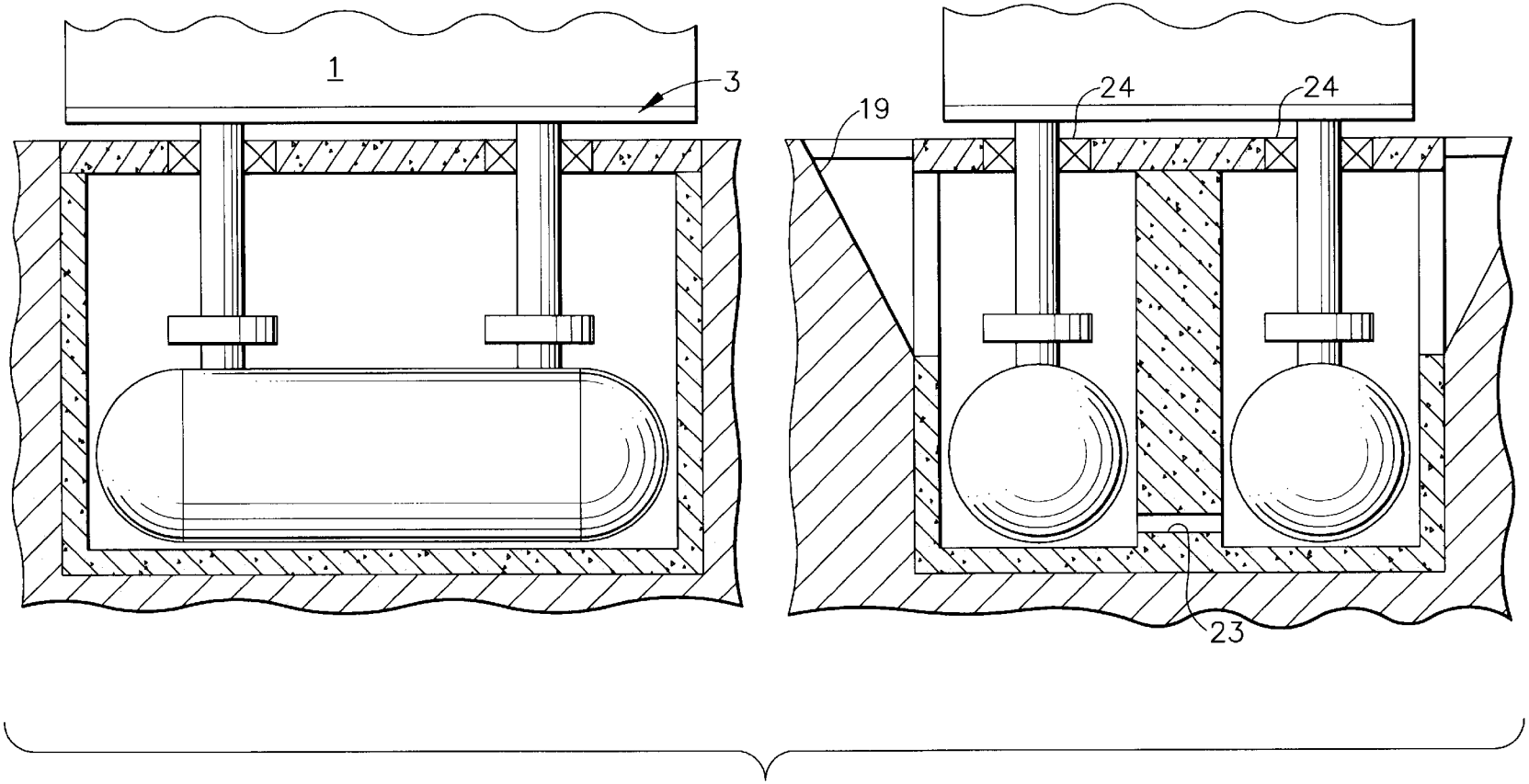
FIG. 5 illustrates, in schematic form, longitudinal and transverse views of a flood control device of the present invention, comprising two nonsealed liquilifts, each comprising a single pontoon attached to two lift rods, and means for admitting floodwater into the outside casings of the two outer casings thereof.
Figure 6:
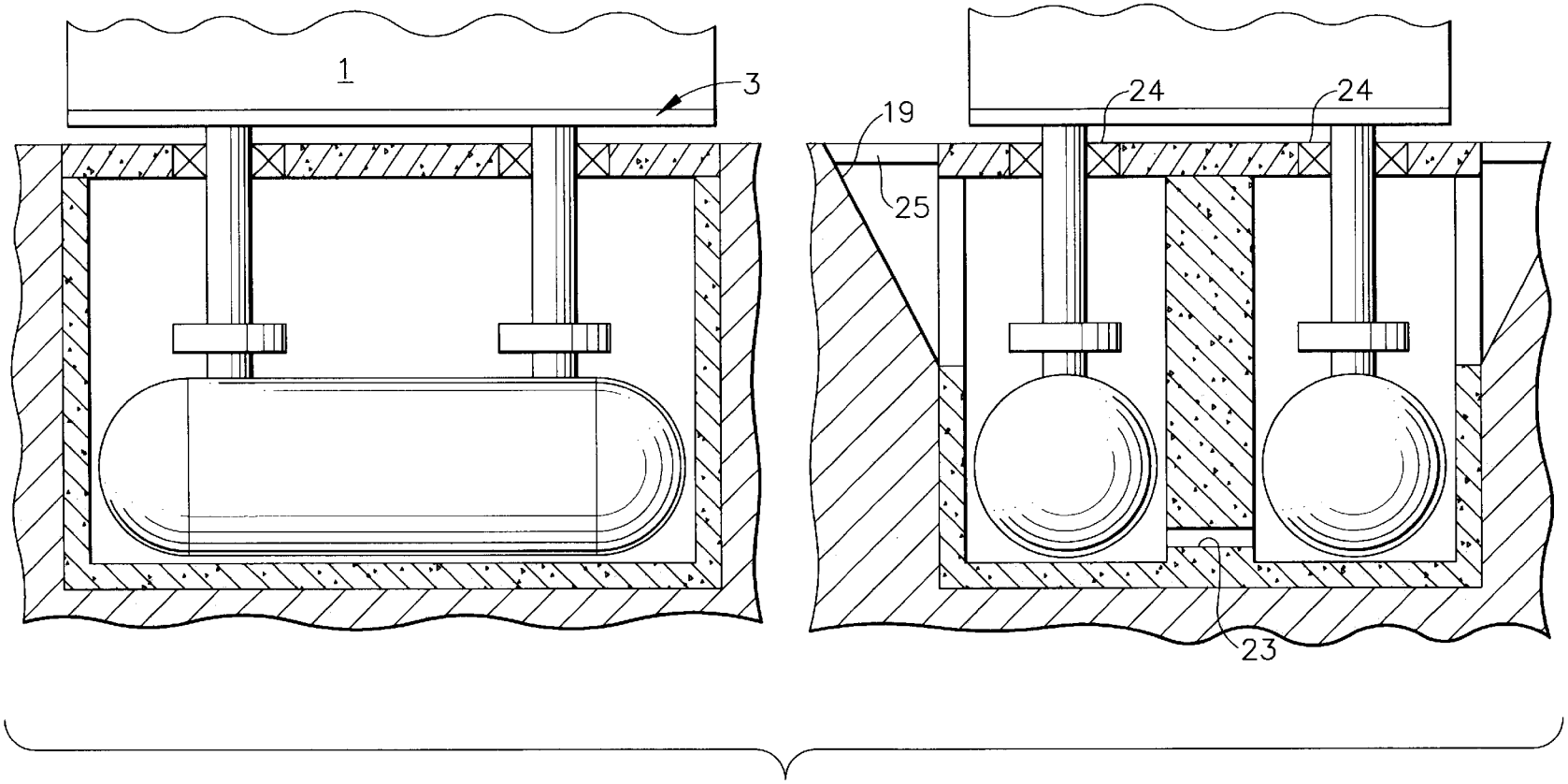
FIG. 6 illustrates, in schematic form, longitudinal and transverse views of a flood control device of the present invention, comprising two nonsealed liquilifts, each comprising a single pontoon attached to two lift rods, and means for controlling the admission of floodwater into the outside casings of the two outer casings thereof.

FIG. 5 illustrates a very simple embodiment of the present invention. In this embodiment, nonsealed liquilifts are employed. When the rising floodwater reaches a critical height, it is admitted to the interior of the outside casing through a port 19, which is preferably covered by a mesh and slotted steel cover to exclude debris carried by the floodwater. If the port is at ground level, filling the outside casing will raise the pontoon and lift rod assembly to its greatest height. If the port is situated at a lower level, and connected to the waterway by an underground pipe, the pontoon and lift rod assembly begins to rise as the floodwater reaches a level slightly above the bottom of the outside casing. The selection of one configuration over the other would depend on the specific application. If desired, interconnecting passages 23 to equalize the water height in the various liquilifts in the flood protection device may be provided. In FIG. 6, a similar configuration is illustrated. In this embodiment, admission of floodwater to the outside casing of a liquilift is controlled by a sliding door, shown at 25. Such a door may be powered by a pneumatic or hydraulic cylinder, or by an electric motor acting through a rack and pinion arrangement. By opening and closing the sliding door, the admission of floodwater is controlled by algorithms built into the control means, or by intervention by an occupant of a building. Means for evacuating water from the outside casing after the floodwater recedes are not shown. A pump could be used, or a drain line to empty the outside casing could be provided.

Figure 7:
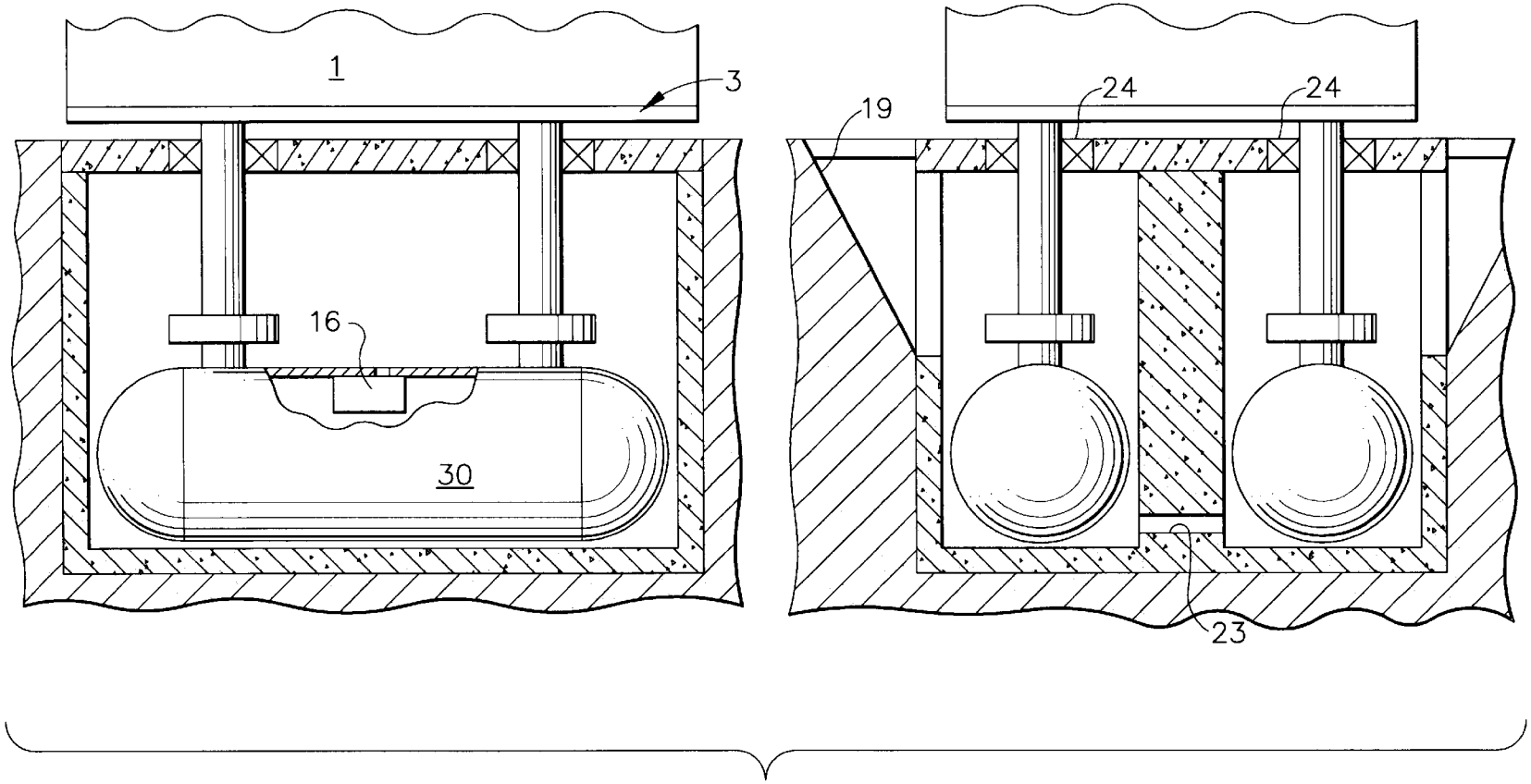
FIG. 7 illustrates, in schematic form, longitudinal and transverse views of a flood control device of the present invention, comprising two sealed liquilifts, each comprising a single pontoon attached to two lift rods.

FIGS. 5–7 all illustrate an embodiment of the present invention in which the pontoons have a cylindrical shape, with hemispherical end caps attached thereto. Two lift rods are attached to each pontoon. This embodiment has the advantage of simplicity of installation and control, although it sacrifices flexibility in leveling the support frame 3. FIG. 7 illustrates the use of sealed liquilifts having one pontoon 30 and two lift rods. Bearing means and seal means, which are particularly important in the configurations shown in FIGS. 6 and 7, are shown collectively at 24.

Figure 8:
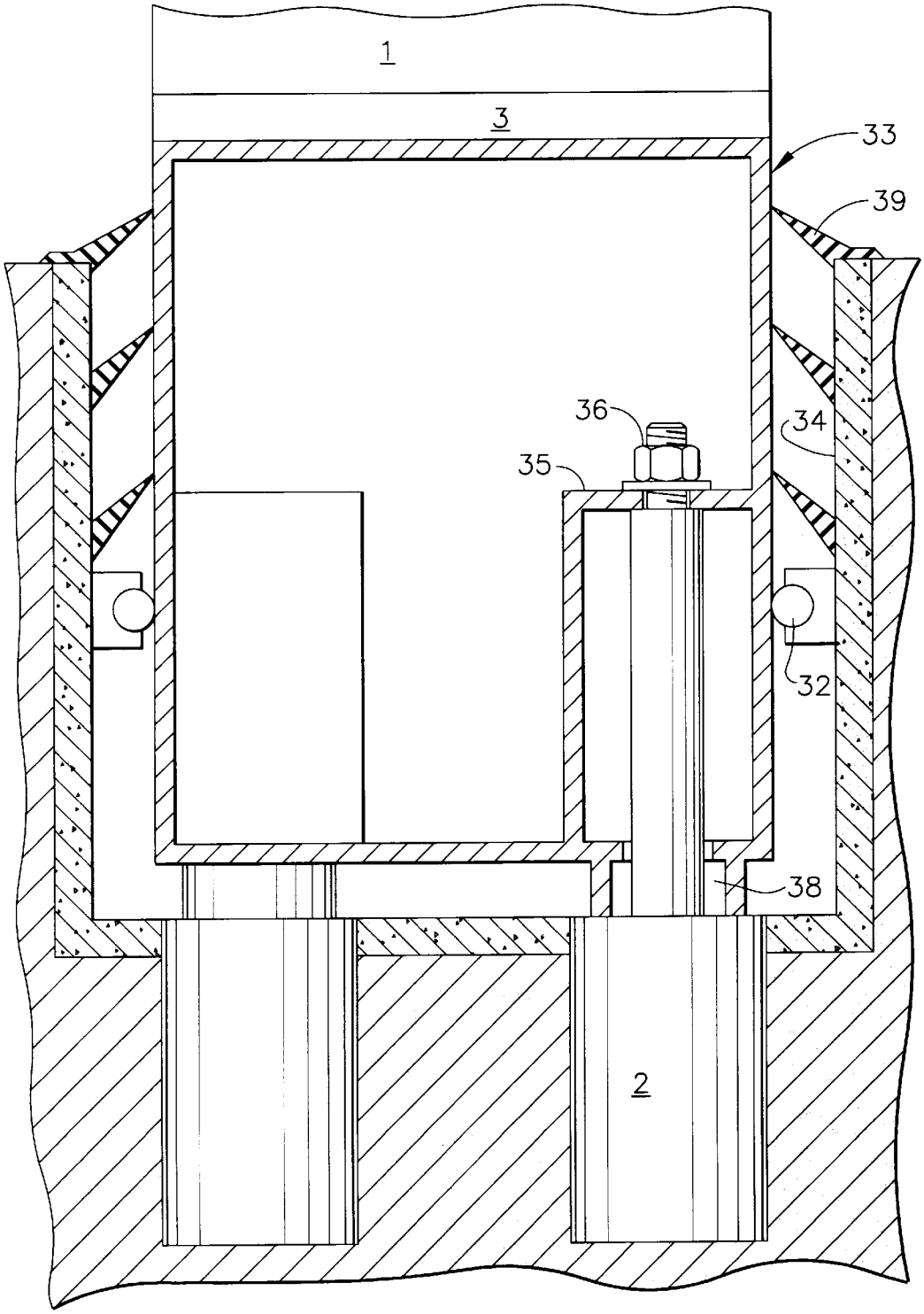
FIG. 8 illustrates, in schematic form, the application of the flood control device of the present invention to a two-story structure, the lower story being normally situated below grade level.

The flood protection device of the present invention is adaptable to protecting a building having a basement that is below ground level, as shown in FIG. 8. The basement is provided with a watertight inner casing 33 and basement casing 34. The liquilifts operate within protective sheaths 35, which conserves vertical space, provide a safety margin against leakage into the basement from a leakage through the liquilift, and allow the support frame 3 to remain above water level. The protective sheaths 35 are attached to the liquilifts by separable means 36. Wiper seals 39 exclude floodwater from the space between the inner casing 33 and the basement casing 34, so that the building cannot float on the buoyancy of the basement. A sump pump 38 is provided to remove any water than may leak into the basement casing 34. Rollers 32 may be provided to facilitate and stabilize vertical movement of the building during actuation of the liquilifts 2.

Preferred embodiments of the flood control device of the present invention incorporate liquilifts as the means for lifting the object being protected above rising floodwaters. However, it is recognized that the function of the liquilifts may be provided by other means, including, but not limited to, hydraulic cylinders analogous to those used to lift automobiles for oil changes and similar maintenance work, a system of pulleys and cables not unlike the construction of elevators, and rack and pinion arrangements. Each of these alternative embodiments is deemed to be reasonably equivalent to that including liquilifts, and within the scope of the appended claims.

Although the present invention has been described with reference to certain preferred embodiments, it will be appreciated that the present invention is not limited thereby. In particular, the concepts of the present invention are fully applicable to alternative means of lifting and supporting the object to be protected. Those skilled in the art will recognize that minor variations and modifications in the design and construction of the flood protection device and the liquilift, as described herein, still lie within the spirit and scope thereof, and such variations and modifications properly fall within the scope of the present invention, which is defined by the following claims.

I claim:

1. A sealed liquilift, comprising:

a) an outside casing, disposed in a vertical orientation, having a bottom and a sidewall, the sidewall having an upper rim and substantially uniform interior configuration and size throughout its vertical length;

b) a cover, mating with the outside casing and being separably attached to the upper rim thereof, having a first seal means to effect a seal between the cover and the outside casing, and comprising a first bearing means and a second seal means centrally disposed therein;

c) a lift rod, having a top, and mating with and being slidably disposed within the first bearing means and the second seal means of the cover;

d) a pontoon, having a top, a bottom and a sidewall, and a sealed cavity therewithin, and being attached to the lift rod, wherein a portion of the sidewall has a configuration and size to cooperate with the interior configuration and size of the outside casing, the pontoon being slidably disposed within the outside casing;

e) an operating liquid confined within the liquilift, and controllably distributed between the outside casing and the pontoon;

f) pump means for transferring a controlled amount of the operating liquid between the outside casing and the sealed cavity;

g) control means for activating the pump and controlling the amount of operating liquid to be transferred between the outside casing and the sealed cavity;

h) a power supply to provide power to operate the control means and the pump means;

i) vent means to equalize air pressure within the outside casing and within the pontoon with ambient atmospheric pressure; and j) stop means to limit the vertical motion of the lift rod and pontoon attached thereto within the outside casing, thereby determining the lowest possible position of the lift rod and pontoon within the outside casing, wherein the first and second seal means, and the outside casing and cover cooperate to exclude from the liquilift any external liquid present outside the liquilift.

2. A liquilift, as recited in claim 1, additionally comprising sensor means for detecting the level of the external liquid.

3. A liquilift, as recited in claim 1, additionally comprising a second bearing means disposed between the pontoon and the sidewall of the outside casing.

4. A liquilift, as recited in claim 1, wherein the cover comprises a plurality of second seal means and a corresponding number of first bearing means, and wherein the corresponding number of lift rods are attached to the pontoon, all such lift rods being slidably disposed with the corresponding second seal means and first bearing means.

5. A nonsealed liquilift, comprising:

a) an outside casing, disposed in a vertical orientation, having a bottom and a sidewall, the sidewall having an upper rim and substantially uniform interior configuration and size throughout its vertical length;

b) a cover, mating with the outside casing and being separably attached to the upper rim thereof, having a first seal means to effect a seal between the cover and the outside casing, and comprising a first bearing means and a second seal means centrally disposed therein;

c) a lift rod, having a top, and mating with and being slidably disposed within the first bearing means and the second seal means of the cover;

d) a pontoon, having a top, a bottom and a sidewall, and a sealed cavity therewithin, and being attached to the lift rod, wherein a portion of the sidewall has a configuration and size to cooperate with the interior configuration and size of the outside casing, the pontoon being slidably disposed within the outside casing;

e) admission means for admitting liquid from outside the liquilift to the interior of the outside casing;

f) evacuation means for removing admitted liquid from the interior of the outside casing to a point outside the liquilift;

g) control means for controlling the amount of liquid admitted to and evacuated from the interior of the outside casing;

h) a power supply to provide power to operate the admission means, the evacuation means and the control means;

i) vent means to equalize air pressure within the outside casing and within the pontoon with ambient atmospheric pressure;

j) stop means to limit the vertical motion of the lift rod and pontoon attached thereto within the outside casing, thereby determining the lowest possible position of the lift rod and pontoon within the outside casing, wherein the first and second seal means, the outside casing and cover, and the admission means cooperate to limit liquid admitted to the liquilift to that admitted through the admission means.

6. A liquilift, as recited in claim 5, additionally comprising sensor means for detecting the level of the external liquid.

7. A liquilift, as recited in claim 5, additionally comprising a second bearing means disposed between the pontoon and the sidewall of the outside casing.

8. A liquilift, as recited in claim 5, wherein the cover comprises a plurality of second seal means and a corresponding number of first bearing means, and wherein the corresponding number of lift rods are attached to the pontoon, all such lift rods being slidably disposed with the corresponding second seal means and first bearing means.

9. A flood protection device comprising:

a) three liquilifts, disposed in a noncollinear arrangement, with the tops thereof arranged in a substantially horizontal plane when the lift rods thereof have all been lowered to a lowest possible position;

b) a support frame, attached to the tops of the three liquilifts;

c) a leveling sensor, to sense orientation of the support frame and any deviation thereof from horizontal;

d) a flood sensor, to sense the level of external liquid present outside the liquilifts;

e) a control system to activate the control systems of the liquilifts in response to signals from the leveling sensor and the flood sensor; and f) a power supply to provide power for the control system, wherein the liquilifts are principal means for raising the support frame above the external liquid.

10. A flood protection device, as recited in claim 9, wherein at least one liquilift is a sealed liquilift, as recited in claim 1.

11. A flood protection device, as recited in claim 9, wherein at least one liquilift is a nonsealed liquilift, as recited in claim 5.

12. A flood protection device, as recited in claim 9, wherein a) the support is attached to the top of the lift rod of a first liquilift in a manner that permits rotation of the support frame, but not translation, with respect to the liquilift, as the lift rod of the first liquilift is extended;

b) the support frame is attached to the top of the lift rod of a second liquilift is a manner that permits rotation of the support frame with respect thereto, and translation of the support frame with respect thereto in a direction radial to the first liquilift, as the lift rod of the second liquilift is extended; and c) the support frame is attached to the top of the lift rod of a third liquilift in a manner that provides translation of the support frame with respect in any direction relative to the first liquilift, as the lift rod of the third liquilift is extended.

13. A flood protection device, as recited in claim 9, wherein the power supply serves additionally as the power supply for at least one liquilift.

14. A flood protection device for protecting a building having a basement, comprising:

a) a basement casing, at least of portion of which is disposed below a prevailing ground level;

b) three liquilifts, disposed within the basement casing in a noncollinear arrangement, with the tops thereof arranged in a substantially horizontal plane when the lift rods thereof have all been lowered to a lowest possible position;

c) a watertight basement, having a rim and comprising three sheaths, the sheaths being disposed to mate with and cooperate with the liquilifts;

d) as support frame, attached to the rim of the basement;

e) a leveling sensor, to sense that the support frame is horizontal;

f) a flood sensor, to sense the level of external liquid present outside the liquilifts;

g) a control system to activate the control systems of the liquilifts in response to signals from the leveling sensor and the flood sensor;

h) a power supply to provide power for the control system; and i) seal means attached to the basement casing, the seal means being disposed to cooperate with the watertight basement to exclude liquids from the basement casing.

* * * * *